US008875810B2

(12) United States Patent
Meister et al.

(10) Patent No.: US 8,875,810 B2
(45) Date of Patent: Nov. 4, 2014

(54) HOLE ENLARGEMENT DRILLING DEVICE AND METHODS FOR USING SAME

(75) Inventors: Matthias Meister, Celle (DE); Wolfgang Eduard Herberg, Bergen (DE); Gunnar Bothman, Celle (DE); Joachim Treviranus, Winsen (DE); Carsten Freyer, Wienhausen (DE); Hans-Robert Oppelaar, Bergen (DE)

(73) Assignee: Baker Hughes Incorporated, Houston, TX (US)

( * ) Notice: Subject to any disclaimer, the term of this patent is extended or adjusted under 35 U.S.C. 154(b) by 422 days.

(21) Appl. No.: 12/689,452

(22) Filed: Jan. 19, 2010

(65) Prior Publication Data

US 2010/0139981 A1 Jun. 10, 2010

Related U.S. Application Data

(63) Continuation-in-part of application No. 11/681,370, filed on Mar. 2, 2007.

(60) Provisional application No. 61/147,911, filed on Jan. 28, 2009, provisional application No. 60/778,329, filed on Mar. 2, 2006.

(51) Int. Cl.
*E21B 44/00* (2006.01)
*E21B 10/32* (2006.01)

(Continued)

(52) U.S. Cl.
CPC ... *E21B 7/06* (2013.01); *E21B 7/04* (2013.01); *E21B 7/062* (2013.01); *E21B 10/26* (2013.01); *E21B 10/32* (2013.01); *E21B 10/322* (2013.01); *E21B 44/00* (2013.01); *E21B 44/005* (2013.01); *E21B 47/022* (2013.01); *E21B 47/08* (2013.01); *E21B 47/09* (2013.01); *E21B 47/12* (2013.01)
USPC ..... 175/263

(58) Field of Classification Search
CPC ..... E21B 10/322; E21B 10/32; E21B 44/005; E21B 44/00
USPC ..... 277/334; 175/263, 267, 270, 272, 273
See application file for complete search history.

(56) References Cited

U.S. PATENT DOCUMENTS 1,678,075 A 7/1928 Phipps
2,069,482 A 2/1937 Seay (Continued)

FOREIGN PATENT DOCUMENTS

EP 246789 A2 11/1987
EP 1036913 A1 9/2000

(Continued)

OTHER PUBLICATIONS

Rasheed, Wajid et al., SPE 92623,"Reducing Risk and Cost in Diverse Well Construction Applications: Eccentric Deice Drills Concentric Hole and Offers a Viable Alternative to Underreamers".

(Continued)

*Primary Examiner* — Shane Bomar
*Assistant Examiner* — Kipp Wallace
(74) *Attorney, Agent, or Firm* — TraskBritt

(57) ABSTRACT

A bottomhole assembly (BHA) coupled to a drill string includes one or more controllers, and a hole enlargement device that selectively enlarges the diameter of the wellbore formed by the drill bit. The hole enlargement device includes an actuation unit that may move extendable cutting elements o the hole enlargement device between a radially extended position and a radially retracted position. The actuation unit may be responsive to a signal that is transmitted from a downhole and/or a surface location. The hole enlargement device may also include one or more position sensors that transmit a position signal indicative of a radial position of the cutting elements. In an illustrative operating mode, one or more operating parameters of the hole enlargement device may be adjusted based on one or more measured parameters. This adjustment may be done in a closed-loop or automated fashion and/or by human personnel.

16 Claims, 5 Drawing Sheets

(51) Int. Cl.

| | |
|---|---|
| ***E21B 7/06*** | (2006.01) |
| ***E21B 7/04*** | (2006.01) |
| ***E21B 10/26*** | (2006.01) |
| ***E21B 47/022*** | (2012.01) |
| ***E21B 47/08*** | (2012.01) |
| ***E21B 47/09*** | (2012.01) |
| ***E21B 47/12*** | (2012.01) |

(56) References Cited

U.S. PATENT DOCUMENTS

| | | | | |
|---|---|---|---|---|
| 2,177,721 | A | | 10/1939 | Johnson et al. |
| 2,344,598 | A | | 3/1944 | Church |
| 2,754,089 | A | | 7/1956 | Kammerer, Jr. |
| 2,758,819 | A | | 8/1956 | Kammerer, Jr. |
| 2,834,578 | A | | 5/1958 | Carr |
| 2,882,019 | A | | 4/1959 | Carr et al. |
| 3,105,562 | A | | 10/1963 | Stone et al. |
| 3,123,162 | A | | 3/1964 | Rowley |
| 3,126,065 | A | | 3/1964 | Chadderdon |
| 3,211,232 | A | | 10/1965 | Grimmer |
| 3,224,507 | A | | 12/1965 | Cordary, Jr. et al. |
| 3,425,500 | A | | 2/1969 | Fuchs |
| 3,433,313 | A | | 3/1969 | Brown |
| 3,556,233 | A | | 1/1971 | Gilreath |
| 4,403,659 | A | | 9/1983 | Upchurch |
| 4,403,664 | A | | 9/1983 | Sullinger |
| 4,413,682 | A | | 11/1983 | Callihan et al. |
| 4,458,761 | A | | 7/1984 | Van Vreeswyk |
| 4,545,441 | A | | 10/1985 | Williamson |
| 4,548,282 | A | | 10/1985 | Hurtz et al. |
| 4,589,504 | A | | 5/1986 | Simpson |
| 4,660,657 | A | | 4/1987 | Furse et al. |
| 4,690,229 | A | | 9/1987 | Raney |
| 4,693,328 | A | | 9/1987 | Furse et al. |
| 4,842,083 | A | | 6/1989 | Raney |
| 4,848,490 | A | | 7/1989 | Anderson |
| 4,854,403 | A | | 8/1989 | Ostertag et al. |
| 4,884,477 | A | | 12/1989 | Smith et al. |
| 4,889,197 | A | | 12/1989 | Boe |
| 5,060,736 | A | | 10/1991 | Neff |
| 5,103,919 | A | | 4/1992 | Warren et al. |
| 5,139,098 | A | | 8/1992 | Blake |
| 5,211,241 | A | | 5/1993 | Mashaw et al. |
| 5,220,963 | A | | 6/1993 | Patton |
| 5,224,558 | A | | 7/1993 | Lee |
| 5,265,684 | A | | 11/1993 | Rosenhauch |
| 5,293,945 | A | | 3/1994 | Rosenhauch et al. |
| 5,305,833 | A | | 4/1994 | Collins |
| 5,307,886 | A | | 5/1994 | Hopper |
| 5,318,131 | A | | 6/1994 | Baker |
| 5,318,137 | A | | 6/1994 | Johnson et al. |
| 5,318,138 | A | | 6/1994 | Dewey et al. |
| 5,332,048 | A | | 7/1994 | Underwood et al. |
| 5,343,963 | A | | 9/1994 | Bouldin et al. |
| 5,361,859 | A | | 11/1994 | Tibbitts |
| 5,368,114 | A | | 11/1994 | Tandberg et al. |
| 5,375,662 | A | | 12/1994 | Echols, III et al. |
| 5,394,951 | A | | 3/1995 | Pringle |
| 5,425,423 | A | | 6/1995 | Dobson et al. |
| 5,437,308 | A | | 8/1995 | Morin et al. |
| 5,553,678 | A | | 9/1996 | Barr et al. |
| 5,560,440 | A | | 10/1996 | Tibbitts |
| 5,603,386 | A | | 2/1997 | Webster |
| 5,740,864 | A | | 4/1998 | de Hoedt et al. |
| 5,787,999 | A | | 8/1998 | Holte |
| 5,788,000 | A | | 8/1998 | Maury et al. |
| 5,823,254 | A | | 10/1998 | Dobson et al. |
| 5,887,655 | A | | 3/1999 | Haugen et al. |
| 5,899,268 | A | | 5/1999 | Lynde et al. |
| 6,000,479 | A | * | 12/1999 | Ambs ..... 175/4.57 |
| 6,039,131 | A | | 3/2000 | Beaton |
| 6,059,051 | A | | 5/2000 | Jewkes et al. |
| 6,070,677 | A | | 6/2000 | Johnston |
| 6,109,354 | A | | 8/2000 | Ringgenberg et al. |
| 6,109,372 | A | | 8/2000 | Dorel et al. |
| 6,116,336 | A | | 9/2000 | Adkins et al. |
| 6,131,675 | A | | 10/2000 | Anderson |
| 6,189,631 | B1 | | 2/2001 | Sheshtawy |
| 6,196,336 | B1 | | 3/2001 | Fincher et al. |
| 6,213,226 | B1 | | 4/2001 | Eppink et al. |
| 6,227,312 | B1 | | 5/2001 | Eppink et al. |
| 6,289,999 | B1 | | 9/2001 | Dewey et al. |
| 6,325,151 | B1 | | 12/2001 | Vincent et al. |
| 6,378,632 | B1 | | 4/2002 | Dewey |
| 6,419,033 | B1 | | 7/2002 | Hahn et al. |
| 6,427,783 | B2 | | 8/2002 | Krueger et al. |
| 6,488,104 | B1 | | 12/2002 | Eppink et al. |
| 6,494,272 | B1 | | 12/2002 | Eppink et al. |
| 6,513,606 | B1 | | 2/2003 | Krueger |
| 6,609,579 | B2 | | 8/2003 | Krueger et al. |
| 6,615,933 | B1 | | 9/2003 | Eddison |
| 6,629,570 | B1 | | 10/2003 | Head |
| 6,668,936 | B2 | | 12/2003 | Williamson, Jr. et al. |
| 6,668,949 | B1 | | 12/2003 | Rives |
| 6,679,328 | B2 | | 1/2004 | Davis et al. |
| 6,705,413 | B1 | | 3/2004 | Tessari |
| 6,708,785 | B1 | | 3/2004 | Russell et al. |
| 6,732,817 | B2 | | 5/2004 | Dewey et al. |
| 6,848,518 | B2 | | 2/2005 | Chen et al. |
| 6,920,944 | B2 | | 7/2005 | Eppink et al. |
| 7,048,078 | B2 | | 5/2006 | Dewey et al. |
| 7,096,978 | B2 | | 8/2006 | Dykstra et al. |
| 7,287,604 | B2 | | 10/2007 | Aronstam et al. |
| 7,303,022 | B2 | | 12/2007 | Tilton et al. |
| 7,306,056 | B2 | | 12/2007 | Ballantyne et al. |
| 7,314,099 | B2 | | 1/2008 | Dewey et al. |
| 7,395,882 | B2 | | 7/2008 | Oldham et al. |
| 7,513,318 | B2 | | 4/2009 | Underwood et al. |
| 7,708,086 | B2 | | 5/2010 | Witte |
| 2001/0042643 | A1 | | 11/2001 | Krueger et al. |
| 2002/0070052 | A1 | | 6/2002 | Armell |
| 2003/0029644 | A1 | | 2/2003 | Hoffmaster et al. |
| 2003/0051881 | A1 | * | 3/2003 | Vinegar et al. ..... 166/374 |
| 2003/0079913 | A1 | | 5/2003 | Eppink et al. |
| 2004/0050589 | A1 | | 3/2004 | Head |
| 2004/0134687 | A1 | * | 7/2004 | Radford et al. ..... 175/57 |
| 2004/0149431 | A1 | | 8/2004 | Wylie et al. |
| 2005/0056463 | A1 | | 3/2005 | Aronstam et al. |
| 2005/0126826 | A1 | | 6/2005 | Moriarty et al. |
| 2005/0139393 | A1 | * | 6/2005 | Maurer et al. ..... 175/57 |
| 2005/0197777 | A1 | * | 9/2005 | Rodney et al. ..... 702/9 |
| 2005/0211470 | A1 | * | 9/2005 | Jeffryes ..... 175/27 |
| 2006/0124354 | A1 | | 6/2006 | Witte |
| 2007/0205022 | A1 | | 9/2007 | Treviranus et al. |
| 2009/0242275 | A1 | * | 10/2009 | Radford et al. ..... 175/57 |
| 2009/0294178 | A1 | * | 12/2009 | Radford ..... 175/57 |
| 2010/0282511 | A1 | * | 11/2010 | Maranuk et al. ..... 175/40 |
| 2011/0284233 | A1 | | 11/2011 | Wu et al. |

FOREIGN PATENT DOCUMENTS

| | | | |
|---|---|---|---|
| EP | 1044314 | A1 | 3/2005 |
| GB | 2319046 | | 5/1998 |
| GB | 2328964 | A | 3/1999 |
| GB | 2344607 | | 6/2000 |
| GB | 2357101 | | 6/2001 |
| GB | 2344122 | B | 4/2003 |
| GB | 2401384 | | 11/2004 |
| WO | 0031371 | A1 | 6/2000 |
| WO | 2004097163 | A1 | 11/2004 |
| WO | WO 2006/112763 | A1 | 10/2006 |

OTHER PUBLICATIONS

International Search Report for International Application No. PCT/US2010/022341 dated Aug. 31, 2010, 4 pages.

International Written Opinion for International Application No. PCT/US2010/022341 dated Aug. 31, 2010, 5 pages.

International Preliminary Report on Patentability for International Application No. PCT/US2010/022341 dated Aug. 2, 2011, 6 pages.

* cited by examiner

HOLE ENLARGEMENT DRILLING DEVICE AND METHODS FOR USING SAME

CROSS-REFERENCE TO RELATED APPLICATIONS

This application claims priority from U.S. Provisional Patent Application Ser. No. 61/147,911, filed Jan. 28, 2009. This application is a continuation-in-part of U.S. application Ser. No. 11/681,370, filed Mar. 2, 2007, which, in turn, claims priority from U.S. Provisional Patent Application Ser. No. 60/778,329, filed Mar. 2, 2006. Each application is incorporated herein by reference in its entirety.

BACKGROUND OF THE DISCLOSURE

1. Field of the Disclosure

This disclosure relates generally to oilfield downhole tools and more particularly to modular drilling assemblies utilized for drilling wellbores having one or more enlarged diameter sections.

2. Description of the Related Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing or tubular string, which is usually either a jointed rigid pipe (or "drill pipe") or a relatively flexible, spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a motor contained in the drilling assembly. In the case of a coiled tubing, the drill bit is rotated by the motor. During drilling, a drilling fluid (also referred to as "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore via an annulus between the drill string and the wellbore wall. The motor, if used, may be rotated by the drilling fluid passing through the drilling assembly, by an electric motor, or other suitable driver. A drive shaft connected to the motor and the drill bit rotates the drill bit.

In certain instances, it may be desired to form a wellbore having a diameter larger than that formed by the drill bit. For instance, in some applications, constraints on wellbore geometry during drilling may result in a relatively small annular space in which cement may flow, reside and harden. In such instances, the annular space may need to be increased to suitably fix a casing or liner in the wellbore. In other instances, an unstable formation such as shale or salt may swell to reduce the diameter of the drilled wellbore and make it difficult to install a liner or casing. To compensate for this swelling, the wellbore may have to be drilled to a larger diameter while drilling through the unstable formation. In still other situations, such as in monobore drilling, it may be desired to increase a diameter of the wellbore to accept casing that is to be expanded. Furthermore, it may be desired to increase the diameter of only certain sections of a wellbore in real-time and in a single trip.

The present disclosure addresses the need for systems, devices and methods for selectively increasing the diameter of a drilled wellbore.

SUMMARY OF THE DISCLOSURE

In aspects, the present disclosure relates to devices and methods for drilling wellbores with one or more preselected bore diameters. An exemplary BHA made in accordance with the present disclosure may be deployed via a conveyance device such as a tubular string, which may be jointed drill pipe or coiled tubing, into a wellbore. The BHA may include a hole enlargement device and tools for measuring selected parameters of interest. In one embodiment, a downhole and/or surface controller control the hole enlargement device. Bidirectional data communication between the BHA and the surface may be provided by a data conductor, such as a wire, formed along a drilling tubular such as jointed pipe or coiled tubing. Mud pulse telemetry, acoustic signals, optical signals, and electromagnetic (EM) signals may also be utilized. The hole enlargement device includes one or more extendable cutting elements that selectively enlarges the diameter of the wellbore formed by the drill bit. In an automated or closed-loop drilling mode, the controller is programmed with instructions for controlling the hole enlargement device in response to a measured parameter of interest. In further aspects, controllers at the surface and/or in the wellbore may be programmed to adjust one or more operating parameters to optimize the relationship between drilling performance and tool wear.

In one arrangement, the hole enlargement device includes an actuation unit that translates or moves the extendable cutting elements between a radially extended position and a radially retracted position. The cutting element may be configured to form a substantially circular wellbore having a diameter larger than the wellbore formed by the drill bit. The actuation unit includes a piston-cylinder-type arrangement that is energized using pressurized fluid, such as clean hydraulic fluid or drilling mud. Valves and valve actuators control the flow of fluid between a fluid reservoir and the piston-cylinder assemblies. An electronics package positioned in the hole enlargement device operates the valves and valve actuators in response to a signal that is transmitted from a downhole and/or a surface location. In some embodiments, the actuation unit is energized using hydraulic fluid in a closed loop. The hole enlargement device may also include one or more position sensors that transmit a position signal indicative of a radial position of the cutting elements. Also, the hole enlargement device may be configured to be operated substantially independently of the steering device.

In one operating mode, the drill string, together with the BHA described above, is conveyed into the wellbore. Drilling fluid pumped from the surface via the drill string energizes the drilling motor, which then rotates the drill bit to drill the wellbore. As needed, the hole enlargement device positioned adjacent the drill bit is activated to enlarge the diameter of the wellbore formed by the drill bit. For instance, surface personnel may transmit a signal to the electronics package for the hole enlargement device that causes the actuation unit to translate the cutting elements from a radially retracted position to a radially extended position. The position sensors, upon detecting the extended position, transmit a position signal indicative of an extended position to the surface. Thus, surface personnel have a positive indication of the position of the cutting elements. Advantageously, surface personnel may activate the hole enlargement device in real-time while drilling and/or during interruptions in drilling activity. For instance, prior to drilling into an unstable formation, the cutting elements may be extended to enlarge the drilled wellbore diameter. After traversing the unstable formation, surface personnel may retract the cutting elements. In other situations, the cutting elements may be extended to enlarge the annular space available for cementing a casing or liner in place.

In one aspect, the present disclosure provides an apparatus for forming a wellbore in an earthen formation. The apparatus may include a drill string; a hole enlargement device positioned along the drill string; and a controller operably coupled to the hole enlargement device. The controller may be responsive to a first signal and a second signal such that the controller activates the hole enlargement device upon receiving the first signal and deactivates the hole enlargement device upon receiving the second signal. In some arrangements, the controller may activate and de-activate the hole enlargement device a plurality of times. Also, the controller may be responsive to a signal such as a pressure pulse, an electrical signal, an optical signal, an EM signal, and/or an acoustic signal. In some aspects, the drill string may include at least one conductor configured to convey an electrical signal, and/or an optical signal. The apparatus may also include at least one sensor that measures a selected parameter of interest. In one arrangement, the hole enlargement device may include at least one cutting element and the sensor may measure a displacement of the at least one cutting element.

In another aspect, the present disclosure provides an apparatus for forming a wellbore in an earthen formation that includes a drill string; a hole enlargement device positioned along the drill string; and an actuator operably coupled to the hole enlargement device via a fluid circuit. The actuator may supply pressurized fluid via the fluid circuit to activate the hole enlargement device. The actuator may have a hydraulic pump. In some arrangements, the hydraulic pump may be energized by a pressurized fluid flowing in the drill string. The hydraulic pump may also be energized by electrical power. In some aspects, the apparatus may include a downhole battery supplying the electrical power, and/or a downhole generator supplying the electrical power. Also, the apparatus may include a conductor coupling the hydraulic pump to a surface electrical power supply.

In still other aspects, the present disclosure provides a method for forming a wellbore in an earthen formation. The method may include enlarging a diameter of the wellbore with a hole enlargement device conveyed on a drill string; measuring a parameter of interest using a sensor positioned on the drill string; and controlling the hole enlargement device in response to the measured parameter of interest. In one aspect wherein the drill string includes a drill bit, the method includes drilling the wellbore with the drill bit; measuring a first parameter of interest using a sensor positioned proximate to the drill bit; and controlling the hole enlargement device in response to the measured parameter of interest and the second parameter of interest. In certain applications, the parameter of interest and the second parameter of interest relate to one of: (i) weight at a selected location on the drill string; (ii) weight at the drill bit; (iii) torque at a selected location on the drill string; and (iv) torque at the drill bit. Also, the method may further include estimating a difference between one of: (i) weight at a selected location on the drill string and weight at the drill bit; and (ii) torque at a selected location on the drill string and torque at the drill bit. In some aspects, the method includes adjusting an operating parameter of the hole enlargement device in response to the estimated difference. Moreover, when the parameter of interest relates to a formation intersected by the wellbore, the method may include adjusting an operating parameter of the hole enlargement device in response to the measured parameter of interest. In applications wherein the parameter of interest relates to a formation intersected by the wellbore and the drill string includes a bottomhole assembly, the method may include adjusting an operating parameter of the bottomhole assembly in response to the measured parameter of interest. Also, in variants, the operating parameter may be one of: (i) weight on the hole enlargement device, (ii) a rotational speed of the hole enlargement device; and (iii) flow rate. Further, the method may include displaying on a display device one of: (i) the measured parameter, and (ii) a value obtained by processing the measured parameter. In some applications, estimating downhole a difference between one of: (i) weight at a selected location on the drill string and weight at the drill bit; and (ii) torque at a selected location on the drill string and torque at the drill bit may be utilized. In applications, displaying on a display device a value of the difference estimated downhole may also be performed.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
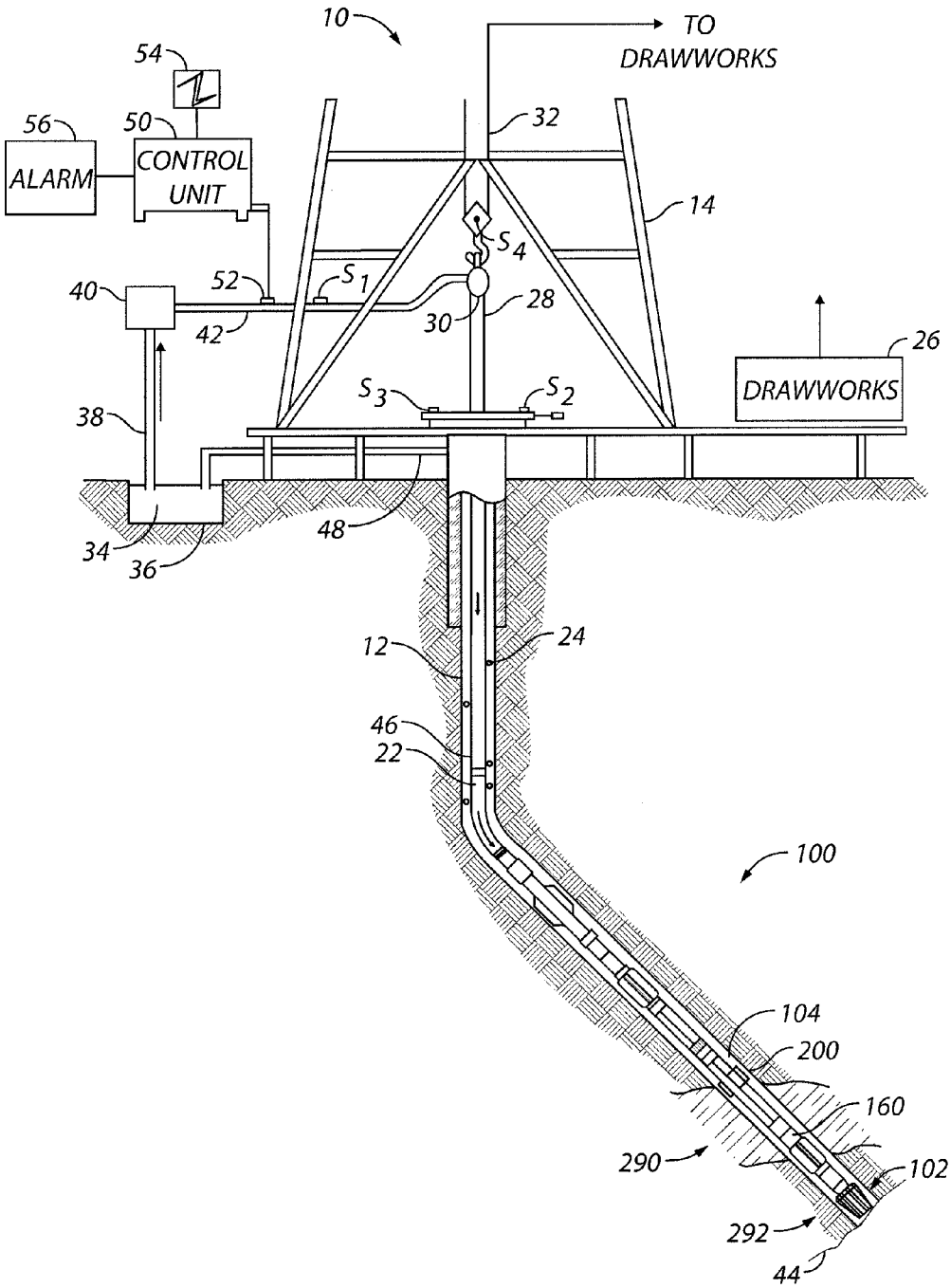
FIG. 1 illustrates a drilling system made in accordance with one embodiment of the present disclosure.

The present disclosure is susceptible to embodiments of different forms. Shown in the drawings and described in detail are specific embodiments of the present disclosure. It should be understood that the present disclosure is an exemplification of the principles of the disclosure, and is not intended to limit the disclosure to that illustrated and described herein.

Referring initially to FIG. 1, there is shown an embodiment of a drilling system 10 utilizing a drilling assembly or bottomhole assembly (BHA) 100 made according to one embodiment of the present disclosure to drill wellbores. While a land-based rig is shown, these concepts and the methods are equally applicable to offshore drilling systems. The system 10 shown in FIG. 1 has a drilling assembly 100 conveyed in a borehole 12. The drill string 22 includes a jointed tubular string 24, which may be drill pipe or coiled tubing, extending downward from a rig 14 into the borehole 12. A drill bit 102, attached to the drill string end, disintegrates the geological formations when it is rotated to drill the borehole 12. The drill string 22, which may be jointed tubulars or coiled tubing, may include power and/or data conductors such as wires for providing bidirectional communication and power transmission. The conductors may be adapted to convey electrical signals, optical signals, and/or electrical power. The present disclosure is not limited to any particular rig or drilling assembly configuration. In some rig arrangements, the drill string 22 is coupled to a drawworks 26 via a kelly joint 28, swivel 30 and line 32 through a pulley (not shown). More commonly, a rig may use a top drive. Also, the drilling system 10 may be a simple rotary system, or a rotary steerable system.

During drilling operations, a suitable drilling fluid 34 from a mud pit (source) 36 is circulated under pressure through the drill string 22 by a mud pump 38. The drilling fluid 34 passes from the mud pump 38 into the drill string 22 via a desurger 40, fluid line 42 and the kelly joint 28. The drilling fluid 34 is discharged at a borehole bottom 44 through an opening in the drill bit 102. The drilling fluid 34 circulates uphole through the annular space 46 between the drill string 22 and the borehole 12 and returns carrying drill cuttings to the mud pit 36 via a return line 48. A sensor $S_1$ preferably placed in the fluid line 42 provides information about the fluid flow rate. A surface torque sensor $S_2$ and a sensor $S_3$ associated with the drill string 22 respectively provide information about the torque and the rotational speed of the drill string 22. Additionally, a sensor $S_4$ associated with line 32 is used to provide the hook load of the drill string 22.

A surface controller 50 receives signals from the downhole sensors and devices via a sensor 52 placed in the fluid line 42 and signals from sensors $S_1$, $S_2$, $S_3$, hook load sensor $S_4$ and any other sensors used in the drilling system 10 and processes, such signals according to programmed instructions provided to the surface controller 50. The surface controller 50 displays desired drilling parameters and other information on a display/monitor 54 and is utilized by an operator to control the drilling operations. The surface controller 50 contains a computer, memory for storing data, recorder for recording data and other peripherals. The surface controller 50 processes data according to programmed instructions and responds to user commands entered through a suitable device, such as a keyboard or a touch screen. The controller 50 is preferably adapted to activate alarms 56 when certain unsafe or undesirable operating conditions occur. As will be described in greater detail below, the controller 50 may be programmed for closed-loop drilling by adjusting one or more parameters (e.g., RPM, hook load, flow rate, etc.) as well as downhole parameters such as azimuth and inclination in order to follow a predefined well trajectory.

Figure 2:
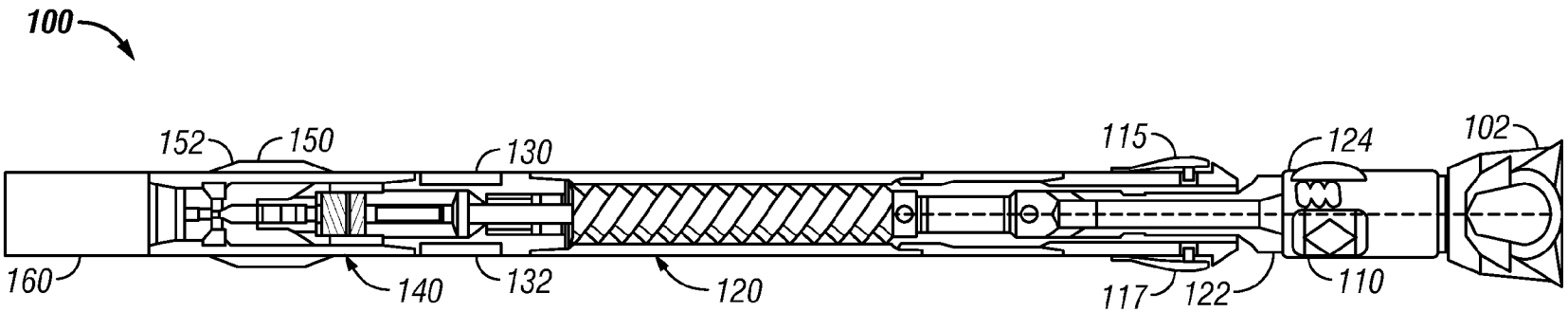
FIG. 2 illustrates an exemplary bottomhole assembly made in accordance with one embodiment of the present disclosure.

Referring now to FIG. 2, there is shown in greater detail an exemplary bottomhole assembly (BHA) 100 made in accordance with the present disclosure. As will be described below, the BHA 100 may automatically drill a wellbore having one or more selected bore diameters. By "automatically," it is meant that the BHA 100 using downhole and/or surface intelligence and based on received sensor data input may control drilling direction using preprogrammed instructions. Drilling direction may be controlled utilizing a selected wellbore trajectory, one or more parameters relating to the formation, and/or one or more parameters relating to operation of the BHA 100. One suitable drilling assembly named VERTI-TRAK® is available from Baker Hughes Incorporated. Some suitable exemplary drilling systems and steering devices are discussed in U.S. Pat. Nos. 6,513,606 and 6,427,783, which are assigned to the same assignee and which are hereby incorporated by reference for all purposes. It should be understood that the present disclosure is not limited to any particular drilling system.

In one embodiment, the BHA 100 includes a drill bit 102, a hole enlargement device 110, a steering device 115, a drilling motor 120, a sensor sub 130, a bidirectional communication and power module (BCPM) 140, a stabilizer 150, and a formation evaluation (FE) sub 160. The steering device 115 is responsive to command signals. The command signals may be generated downhole and/or at the surface. Thus, the steering device 115 may be re-oriented or reconfigured in situ to change drilling direction without retrieving the BHA 100 from the wellbore. In an illustrative embodiment, the hole enlargement device 110 is integrated into a motor flex shaft 122 using a suitable electrical and mechanical connection 124. The hole enlargement device 110 may be a separate module that is mated to the motor flex shaft 122 using an appropriate mechanical joint and data and/or power connectors. In another embodiment, the hole enlargement device 110 is structurally incorporated in the motor flex shaft 122 itself. The steering device 115 and the hole enlargement device 110 may share a common power supply, e.g., hydraulic or electric, and a common communication system. In embodiments, drill bit 102, the steering device 115, and the hole enlargement device 110 are axially spaced apart. Additionally, the steering device 115 may be operated to steer the BHA 100 during drilling without operating the hole enlargement device 110 (i.e., without enlarging the wellbore diameter) and the hole enlargement device 110 may be operated without operating the steering device 115 (i.e., generating steering forces to steering the BHA 100).

To enable power and/or data transfer to the hole enlargement device 110 and among the other tools making up the BHA 100, the BHA 100 includes a power and/or data transmission line (not shown). The power and/or data transmission line (not shown) may extend along the entire length of the BHA 100 up to and including the hole enlargement device 110 and the drill bit 102. Exemplary uplinks, downlinks and data and/or power transmission arrangements are described in commonly owned U.S. patent application Ser. No. 11/282,995, filed Nov. 18, 2005, now U.S. Pat. No. 7,708,086, issued May 4, 2010, which is hereby incorporated by reference for all purposes.

The hole enlargement device 110 may include expandable cutting elements. In embodiments, the cutting elements may be actuated or extended simultaneously. For instance, at least two cutting elements may engage a wellbore wall surface at the same time. Surface personnel may use the power and/or data link between the hole enlargement device 110 and BCPM 140 and the surface to determine the position of the hole enlargement device cutting elements (i.e., expanded or retracted) and to issue instructions to cause the cutting elements to move between an expanded and retracted position. Thus, for example, the hole enlargement device cutting elements can be shifted to an expanded position as the BHA 100 penetrates a swelling formation such as shale and later returned to a retracted position as the BHA 100 penetrates into a more stable formation. One suitable hole enlargement device is referred to as an "underreamer" in the art.

Figure 3:
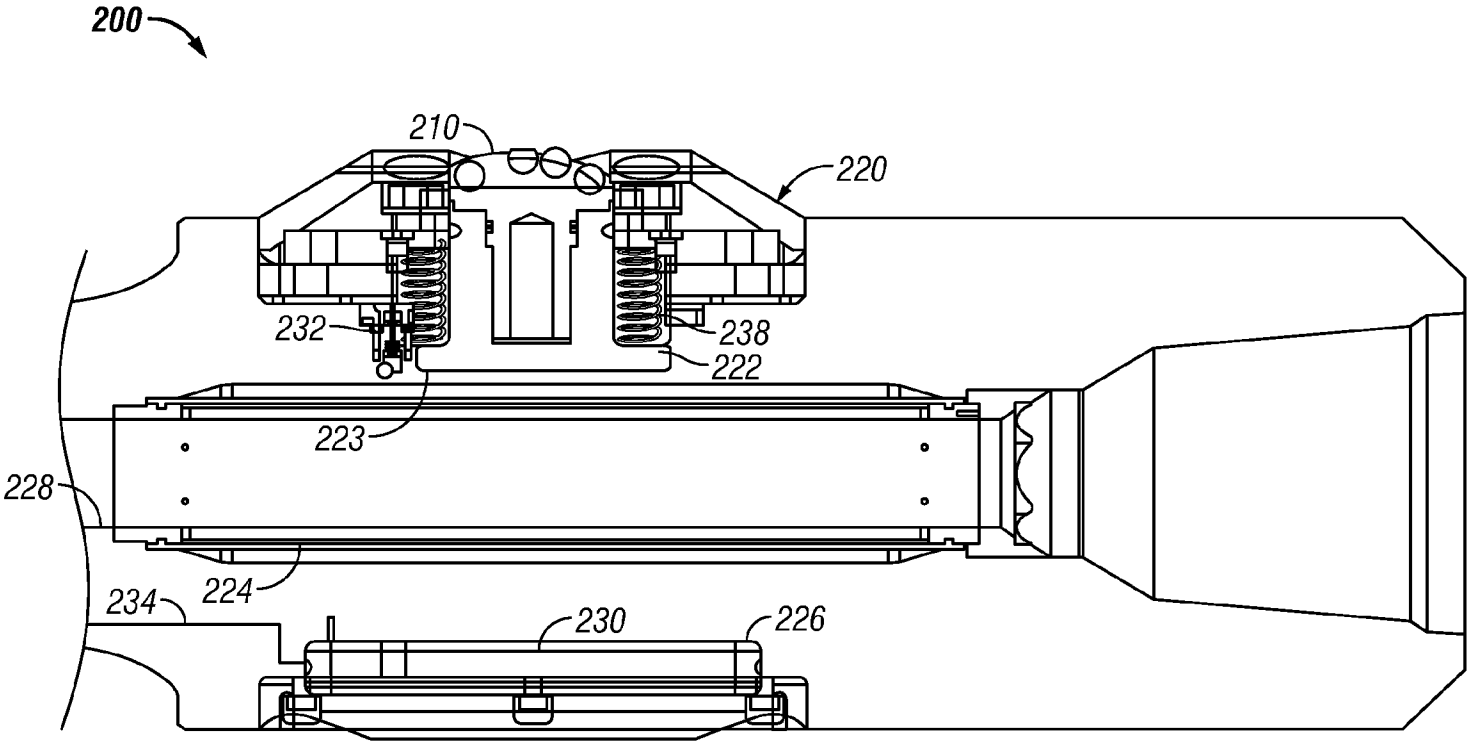
FIG. 3 illustrates an exemplary hole enlargement device made in accordance with one embodiment of the present disclosure.

Referring now to FIG. 3, there is shown one embodiment of a hole enlargement device 200 made in accordance with the present disclosure that can drill or expand the hole drilled by the drill bit 102 (FIGS. 1 and 2) to a larger substantially circular diameter. In one embodiment, the hole enlargement device 200 includes a plurality of circumferentially spaced-apart cutting elements 210 that may, in real-time, be extended and retracted by an actuation unit 220. The cutting elements 210 may be extended substantially simultaneously to form a wellbore having a generally circular cross-sectional shape. That is, the cutting elements 210 do not preferentially cut the wellbore wall, because such a cutting action would yield an asymmetric cross-sectional shape (e.g., a non-circular shape). When extended, the cutting elements 210 scrape, break-up and disintegrate the wellbore surface formed initially by the drill bit 102. In one arrangement, the actuation unit 220 utilizes pressurized hydraulic fluid as the energizing medium. For example, the actuation unit 220 may include a piston 222 disposed in a cylinder 223, an oil reservoir 224, and valves 226 that regulate flow into and out of the cylinder 223. A cutting element 210 is fixed on each piston 222. The actuation unit 220 uses "clean" hydraulic fluid that flows within a closed loop. The hydraulic fluid may be pressurized using pumps and/or by the pressurized drilling fluid flowing through a bore 228. In one embodiment, a common power source (not shown), such as a pump and associated fluid conduits, supplies pressurized fluid for both the hole enlargement device 110 and the steering unit 115 (FIG. 2). Thus, in this regard, the hole enlargement device 110 and the steering unit 115 may be considered as hydraulically operatively connected. An electronics package 230 controls valve components such as actuators (not shown) in response to surface and/or downhole commands and transmits signals indicative of the condition and operation of the hole enlargement device 200. A position sensor 232 fixed adjacent to the cylinder 223 provides an indication as to the radial position of the cutting elements 210. For example, the position sensor 232 may include electrical contacts that close when the cutting elements 210 are extended. The position sensor 232 and electronics package 230 communicate with the BCPM 140 (FIG. 2) via a line 234. Thus, for instance, surface personnel may transmit instructions from the surface that cause the electronics package 230 to operate the valve actuators for a particular action (e.g., extension or retraction of the cutting elements 210). A signal indicative of the position of the cutting elements 210 is transmitted from the position sensor 232 via the line 234 to the BCPM 140 and, ultimately, to the surface where it may, for example, be displayed on display 54 (FIG. 1). The cutting elements 210 may be extended or retracted in situ during drilling or while drilling is interrupted. Optionally, devices such as biasing elements such as springs 238 may be used to maintain the cuttings elements 210 in a retracted position.

In other embodiments, the actuation unit 220 may use devices such as an electric motor or employ shape-changing materials such as magnetostrictive or piezoelectric materials to translate the cutting elements 210 between the extended and retracted positions. In still other embodiments, the actuation unit 220 may be an "open" system that utilizes the circulating drilling fluid to displace the piston 222 within the cylinder 223. Thus, it should be appreciated that embodiments of the hole enlargement device 200 may utilize mechanical, electromechanical, electrical, pneumatic and hydraulic systems to move the cutting elements 210.

Additionally, while the hole enlargement device 200 is shown as integral with the motor shaft 122, in other embodiments the hole enlargement device 200 may be integral with the drill bit 102 (FIGS. 1 and 2). For example, the hole enlargement device 200 may be adapted to connect to the drill bit 102. Alternatively, the drill bit 102 body may be modified to include radially expandable cutting elements (not shown). In still other embodiments, the hole enlargement device 200 may be positioned in a sub positioned between the steering device 115 (FIG. 2) and the drill bit 102 or elsewhere along the drill string 22 (FIG. 1). Moreover, the hole enlargement device 200 may be rotated by a separate motor (e.g., mud motor, electric motor, pneumatic motor) or by drill string rotation. It should be appreciated that the above-described embodiments are merely illustrative and not exhaustive. For example, other embodiments within the scope of the present disclosure may include cutting elements in one section of the BHA 100 and the actuating elements in another section of the BHA 100. Still other variations will be apparent to one skilled in the art given the present teachings.

As previously discussed, embodiments of the present disclosure are utilized during "automated" drilling. In some application, the drilling is automated using downhole intelligence that control drilling direction in response to directional data (e.g., azimuth, inclination, north) measured by onboard sensors. The intelligence may be in the form of instructions programmed into a downhole controller that is operatively coupled to the steering device. Discussed in greater detail below are illustrative tools and components suitable for such applications.

Referring now to FIG. 2, the data used to control the BHA 100 is obtained by a variety of tools positioned along the BHA 100, such as the sensor sub 130 and the formation evaluation sub 160. The sensor sub 130 may include sensors for measuring near-bit direction (e.g., BHA azimuth and inclination, BHA coordinates, etc.), dual rotary azimuthal gamma ray, bore and annular pressure (flow-on and flow-off), temperature, vibration/dynamics, multiple propagation resistivity, and sensors and tools for making rotary directional surveys.

The formation evaluation sub 160 may include sensors for determining parameters of interest relating to the formation, borehole, geophysical characteristics, borehole fluids and boundary conditions. These sensors include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid.

The subs 130 and 160 may include one or more memory modules and a battery pack module to store and provide back-up electrical power, and may be placed at any suitable location in the BHA 100. Additional modules and sensors may be provided depending upon the specific drilling requirements. Such exemplary sensors may include an RPM sensor, sensor for measuring weight on the drill bit/hole enlargement device, sensors for measuring torque on the drill bit/hole enlargement device, sensors for measuring mud motor parameters (e.g., mud motor stator temperature, differential pressure across a mud motor, and fluid flow rate through a mud motor), and sensors for measuring vibration, whirl, radial displacement, stick-slip, torque, shock, vibration, strain, stress, bending moment, bit bounce, axial thrust, friction and radial thrust. The near bit inclination devices may include three (3) axis accelerometers, gyroscopic devices and signal processing circuitry as generally known in the art. These sensors may be positioned in the subs 130 and 160, distributed along the drill pipe, in the drill bit 102 and along the BHA 100. Further, while subs 130 and 160 are described as separate modules, in certain embodiments, the sensors described above may be consolidated into a single sub or separated into three or more subs. The term "sub" refers merely to any supporting housing or structure and is not intended to mean a particular tool or configuration.

For automated drilling, a processor 132 processes the data collected by the sensor sub 130 and formation evaluation sub 160 and transmits appropriate control signals to the steering device 115. In response to the control signals, pads 117 of the steering device 115 extend to apply selected amounts of force to the wellbore wall (not shown). The applied forces create a force vector that urges the drill bit 102 in a selected drilling direction. The processor 132 may also be programmed to issue instructions to the hole enlargement device 110 and/or transmit data to the surface. The processor 132 may be configured to decimate data, digitize data, and include suitable PLCs. For example, the processor 132 may include one or more microprocessors that uses a computer program implemented on a suitable machine-readable medium that enables the processor 132 to perform the control and processing. The machine-readable medium may include ROMs, EPROMs, EAROMs, Flash memories and optical disks. Other equipment such as power and data buses, power supplies, and the like, will be apparent to one skilled in the art. While the processor 132 is shown in the sensor sub 130, the processor 132 may be positioned elsewhere in the BHA 100. Moreover, other electronics, such as electronics that drive or operate actuators for valves and other devices may also be positioned along the BHA 100.

The bidirectional data communication and power module ("BCPM") 140 transmits control signals between the BHA 100 and the surface, as well as supplies electrical power to the BHA 100. For example, the BCPM 140 provides electrical power to devices such as the hole enlargement device 110 and steering device 115 and establishes two-way data communication between the processor 132 and surface devices such as the controller 50 (FIG. 1). In this regard, hole enlargement device 110 and the steering device 115 may be considered electrically operatively connected. In one embodiment, the BCPM 140 generates power using a mud-driven alternator (not shown) and the data signals are generated by a mud pulser (not shown). The mud-driven power generation units (mud pursers) are known in the art and thus, not described in greater detail. In addition to mud pulse telemetry, other suitable two-way communication links may use hard wires (e.g., electrical conductors, fiber optics), acoustic signals, EM or RF. Of course, if the drill string 22 (FIG. 1) includes data and/or power conductors (not shown), then power to the BHA 100 may be transmitted from the surface.

The BHA 100 also includes the stabilizer 150, which has one or more stabilizing elements 152 and is disposed along the BHA 100 to provide lateral stability to the BHA 100. The stabilizing elements 152 may be fixed or adjustable.

Referring now to FIGS. 1-3, in an exemplary manner of use, the BHA 100 is conveyed into the borehole 12 from the rig 14. During drilling of the borehole 12, the steering device 115 steers the drill bit 102 in a selected direction. In one mode of drilling, only the mud motor 104 rotates the drill bit 102 (sliding drilling) and the drill string 22 remains relatively rotationally stationary as the drill bit 102 disintegrates the formation to form the borehole 12. The drilling direction may follow a preset trajectory that is programmed into a surface and/or downhole controller (e.g., controller 50 and/or controller 132). The controller(s) use directional data received from downhole directional sensors to determine the orientation of the BHA 100, compute course correction instructions if needed, and transmit those instructions to the steering device 115. During drilling, the radial position (e.g., extended or retracted) of the cutting elements 210 is displayed on the display 54.

At some point during the drilling activity, surface personnel may desire to enlarge the diameter of the well being drilled. Such an action may be due to encountering a formation susceptible to swelling, due to a need for providing a suitable annular space for cement or for some other drilling considerations such as swelling salt or unstable shale formations. Surface personnel may transmit a signal using the communication downlink (e.g., mud pulse telemetry) that causes the downhole electronics package 230 to energize the actuation unit 220, which in turn extends the cutting elements 210 radially outward. When the cutting elements 210 reach their extended position, the position sensor 232 transmits a signal indicative of the extended position, which is displayed on display 54. Thus, surface personnel are affirmatively notified that the hole enlargement device 110 is extended and operational. With the hole enlargement device 110 activated, automated drilling may resume (assuming drilling was interrupted—which is not necessary). The drill bit 102, which now acts as a type of pilot bit, drills the wellbore to a first diameter while the extended cutting elements 210 enlarge the wellbore to a second, larger diameter. Because the cutting elements 210 may be extended simultaneously, the cross-section of the resulting hole is substantially circular in shape. The BHA 100 under control of the processors 50 and/or 132 continues to automatically drill the formation by adjusting or controlling the steering device 115 as needed to maintain a desired wellbore path or trajectory. If at a later point personnel decide that an enlarged wellbore is not necessary, a signal transmitted from the surface to the downhole electronics package 230 causes the cutting elements 210 to retract. The position sensor 232, upon sensing the retraction, generates a corresponding signal, which is ultimately displayed on display 54. It should be understood, that the cutting elements 210 may be expanded and retracted a plurality of times during a single drilling trip into the wellbore. That is, as the BHA 100 traverses multiple layers of the formation during a single trip, the cutting elements 210 may be extended and retracted a plurality of times during that single trip; i.e., without being extracted out of the well.

It should be understood that the above drilling operation is merely illustrative. For example, in other operations, surface and/or downhole processors may be programmed to automatically extend and retract cutting elements as needed. As may be appreciated, the teachings of the present application may readily be applied to other drilling systems. Such other drillings systems include BHAs coupled to a rotating drilling string and BHAs, wherein rotation of the drill string is superimposed on the mud motor rotation.

Figure 4:
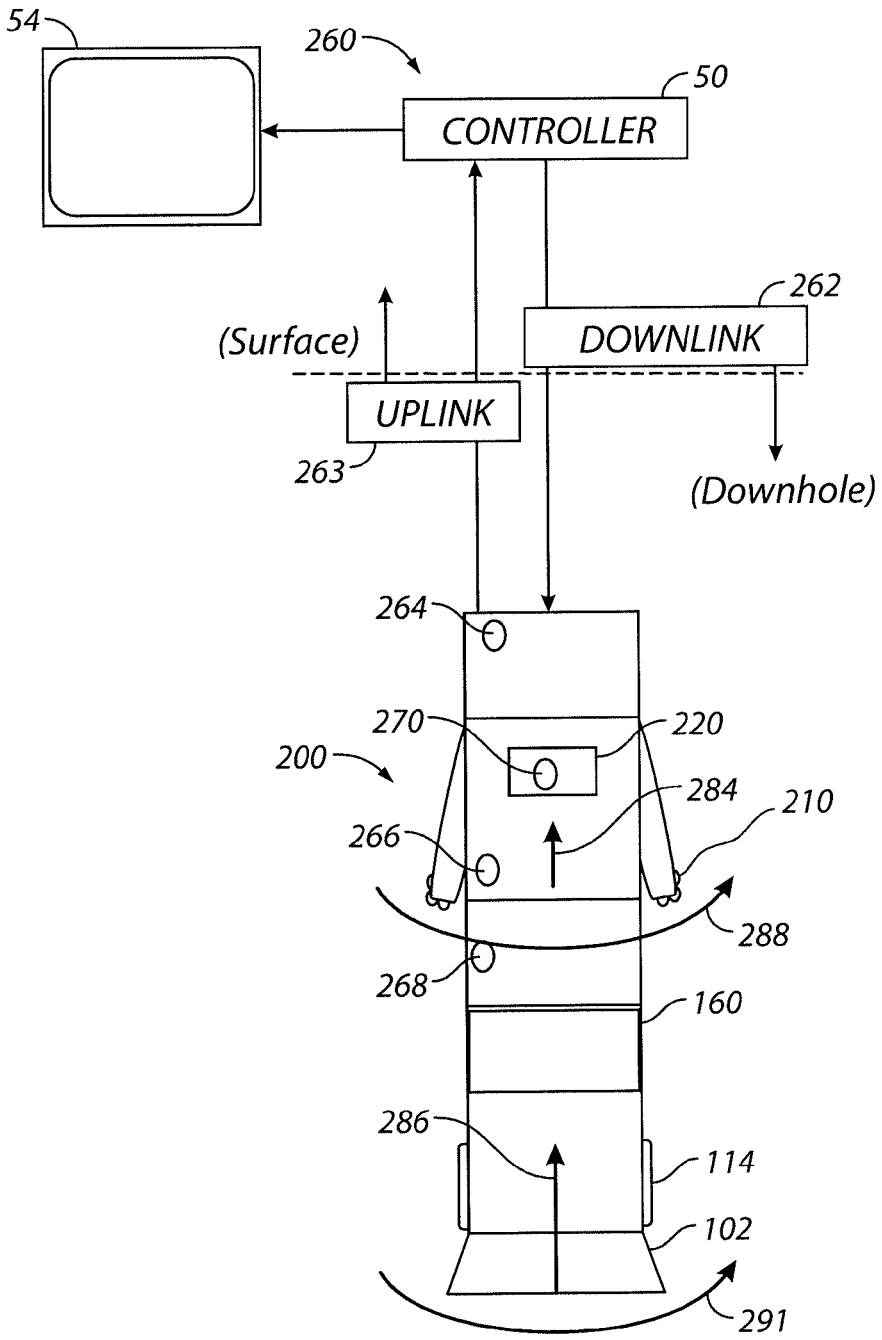
FIG. 4 illustrates another embodiment of a hole enlargement device made in accordance with one embodiment of the present disclosure.

Referring now to FIG. 4, there is shown an embodiment of a control system 260 for operating a hole enlargement device 200. As described previously, a surface controller 50 may utilize a communication device to transmit downlinks 262 and receive uplinks 263 from the hole enlargement device 200. The communication device (not shown) may utilize mud pulse telemetry, hard wires (e.g., electrical conductors, fiber optics), acoustic signals, EM or RF. The surface controller 50 displays desired drilling parameters and other information on the display/monitor 54. In arrangements, the control system 260 enables an operator to transmit commands for extending/opening and retracting/closing the cutting elements 210 of the hole enlargement device 200 (see FIG. 3). Additionally, the control system 260 allows the operator to receive information that relates to the operating status, health, or condition of the hole enlargement device 200, information relating to one or more parameters relating to the wellbore such as borehole geometry, information relating to the formation being drilled, and information relating to wellbore conditions (e.g., pressure and temperature). To obtain such information, the hole enlargement device 200 may include one or more sensors 264 uphole of the cutting elements 210, one or more sensors 266 in a housing of the hole enlargement device 200, and one or more sensors 268 downhole of the cutting elements 210.

The sensors 264, 268 uphole and downhole of the cutting elements 210 may measure physical drilling characteristics that can be processed to determine the forces at or being applied to the cutting elements 210. For instance, the sensors 264, 268 may measure weight on bit above and below the cutting elements 210, respectively. Using known mathematical models, these measurements may be used to estimate the weight on the hole enlargement device 200 (or WOR 284 as described below) at the cutting elements 210. Similarly, the sensors 264, 268 may measure torque on bit uphole and downhole of the cutting elements 210 to allow an estimation of the torque (or TOR 288 as described below) at the cutting elements 210. In like manner, estimation of bending forces and other drilling dynamics may be made for the hole enlargement device 200 and cutting elements 210.

The sensors 266 at the hole enlargement device 200 may include sensors for measuring RPMs, temperature, pressure, acceleration, vibration, whirl, radial displacement, stick-slip, torque, strain, stress, bending moment, bit bounce, axial thrust, friction, backward rotation, BHA buckling and radial thrust. For example the sensors 270 at the actuation unit 220 may include sensors for measuring hydraulic pressure, temperature, and position of various components making up the actuation unit 220. In embodiments, one or more sensors may be utilized to measure the radial displacement of the cutting elements 210. One illustrative length measurement device for such a function includes a longitudinal variable displacement transducer. The length measurement device may be used to determine the radial extension of a cutting element 210, which then may be used to estimate a diameter of the drilled borehole. Thus, an indirect caliper-like measurement of the borehole may be obtained.

Also, as described previously, sensors distributed along the drill string can measure physical quantities such as drill string acceleration and strain, internal pressures in the drill string bore, external pressure in the annulus, vibration, temperature, electrical and magnetic field intensities inside the drill string, bore of the drill string, etc. Suitable systems for making dynamic downhole measurements include COPILOT®, a downhole measurement system, manufactured by Baker Hughes Incorporated.

Referring still to FIG. 4, it should be appreciated that the drilling system shown has been arranged differently from that shown in FIGS. 1 and 2. In FIGS. 1 and 2, the steering device 115 and the formation evaluation sub 160 are positioned uphole of the hole enlargement device 100. In FIG. 4, a steering device 114 and the formation evaluation sub 160 are positioned downhole of the hole enlargement device 200. In the FIG. 4 configuration, pads of the steering device 114 may be more closely positioned to the wall of the wellbore, which requires a smaller radial extension of the pads of the steering device 114. Also, the sensors and tools of the formation evaluation sub 160 may be more closely positioned to the wall of the wellbore, which generally allows such sensors and tools to obtain more accurate measurements for the adjacent formation. It should be understood that the present teachings are not limited to any particular configuration and that in certain embodiments, the steering device 114 and/or the formation evaluation sub 160 may be omitted.

Referring now to FIG. 3, as described previously, the hole enlargement device 200 includes a plurality of circumferentially spaced-apart cutting elements 210 that may, in real-time, be extended and retracted by the actuation unit 220. In one illustrative arrangement, the actuation unit 220 utilizes pressurized hydraulic fluid as the energizing medium. For example, the actuation unit 220 may include a piston 222 disposed in a cylinder 223, an oil reservoir 224, and valves 226 that regulate flow into and out of the cylinder 223. A cutting element 210 is fixed on each piston 222. The actuation unit 220 uses "clean" hydraulic fluid that flows within a closed loop. The hydraulic fluid may be pressurized using pumps and/or by the pressurized drilling fluid flowing through the bore 228. An electronics package 230 controls valve components such as actuators (not shown) in response to surface and/or downhole commands and transmits signals indicative of the condition and operation of the hole enlargement device 200.

Figure 5:
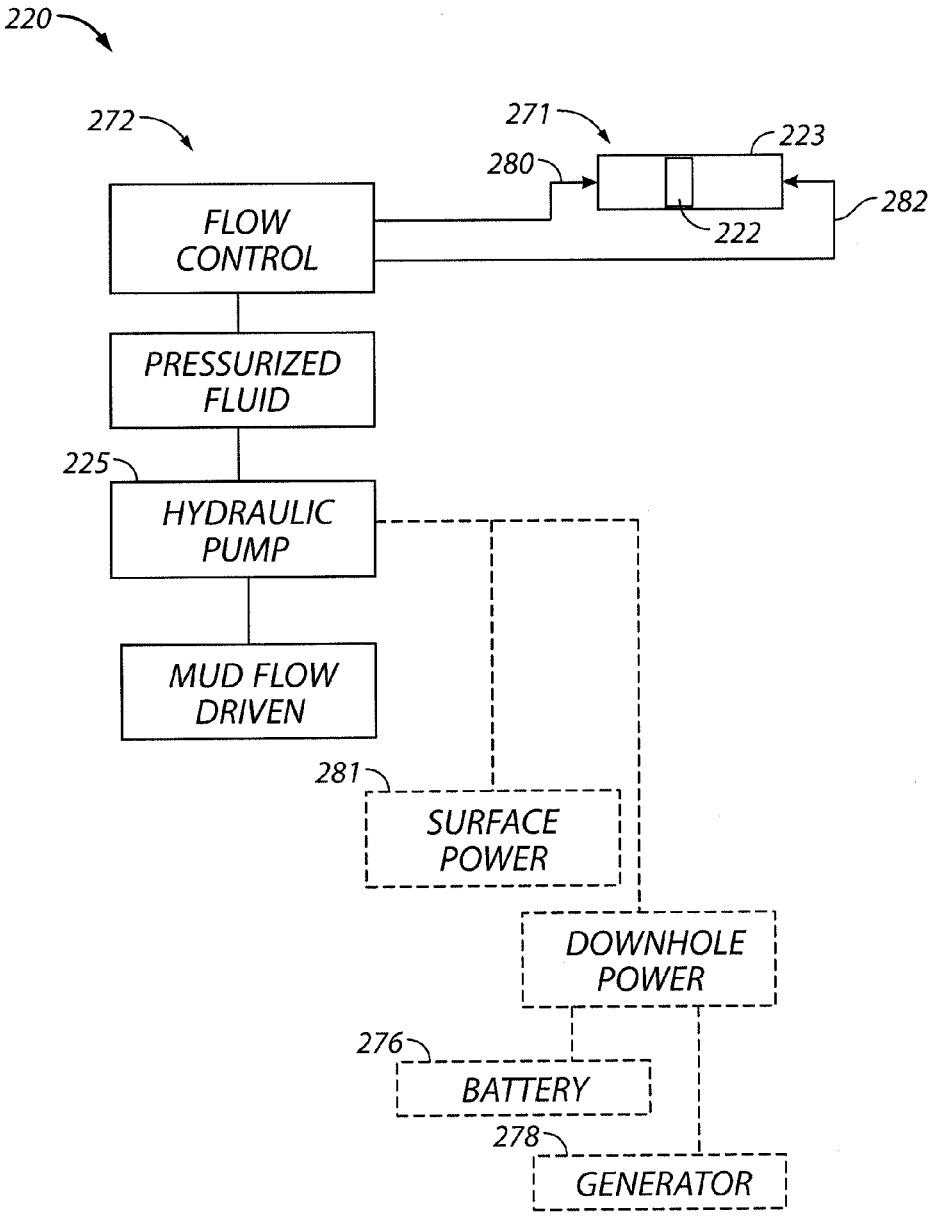
FIG. 5 illustrates various embodiments of actuation arrangements for a hole enlargement device made in accordance with one embodiment of the present disclosure.

Referring now to FIG. 5, there are shown various illustrative arrangements for energizing the actuation unit 220. In FIG. 5, a radial displacement mechanism 271, e.g., piston 222, cylinder 223, for moving the cutting elements 210 (FIG. 3) receives pressurized fluid from a flow control unit 272, which may include valves and other fluid flow regulation devices. In one embodiment, a single piston 222 is used to simultaneously extend and retract all the cutting elements 210. In other embodiments, each cutting element 210 may have its own piston 222, but the cutting elements 210 may still be extended and retracted substantially simultaneously. The pressurized fluid is supplied by a hydraulic pump 224. In one embodiment, the hydraulic pump 224 is driven by the flow of pressurized drilling fluid through the bore of the drill string 22 (FIG. 1). However, other alternative or supplementary sources for supplying power may also be utilized. For example, for embodiments wherein an electric motor (not shown) is used to drive the hydraulic pump 224, electrical power may be supplied by a downhole battery 276 or a downhole generator 278. Also, electrical power may be supplied from the surface 281.

In embodiments, the actuation unit 220 uses pressurized fluid to extend and retract the cutting elements 210. As noted previously, biasing elements 238 may be used to bias or urge the cutting elements 210 into a retracted or closed position. Alternatively, or in addition to the use of biasing mechanisms, the flow control system 272 may apply pressurized fluid to the radial displacement system 2710 such that hydraulic pressure drives the pistons 222 in a radially outward position and a radially inward position. For illustration, arrow 280 shows pressurized fluid entering one chamber of the cylinder 223 and arrow 282 shows pressurized fluid entering an opposing chamber of the cylinder 223. Thus, the piston 222, and attached cutting elements 210 (FIG. 3) may positively driven by pressure in both directions.

The devices of the present disclosure may be advantageously utilized in a number of situations. One illustrative situation or application involves wellbores that have trajectories that intersect one or more unstable layers that may include shale or swelling salt. Referring now to FIG. 1, the drill bit 102 is shown as exiting a relatively unstable layer 290 and entering a relatively stable layer 292. The hole enlargement device 200 is still uphole of the unstable layer 290. By "unstable," it is generally meant that the profile or geometry of the borehole 12 in the unstable layer 290 may change. In particular, the cross-sectional shape of the borehole 12 may deform from a generally circular shape to an elliptical shape—which reduces the effective diameter of the borehole 12. This deformation may occur within days or even hours of the borehole 12 being drilled by the drill bit 102. In some instances, this deformation shrinks the effective diameter of the borehole 12 to such a degree that the drill bit 102 or even the drill string 22 cannot pass through. Thus, in those situations, the hole enlargement device 200 may be selectively activated to increase the diameter of the borehole 12 in the unstable layer 290 relative to the diameter of the borehole 12 in the stable layer 292 such that, even after deformation, the effective diameter of the wellbore 12 allows passage of the drill string 22 through the borehole 12 along the unstable layer 292. Thus, multiple unstable layers 292 may be traversed in a single trip into the well and the wellbore may be enlarged as those unstable layers 292 are being traversed.

In one mode of operation, the operator continually processes and evaluates measurements obtained from the formation evaluation sub 160 and other downhole tools to characterize the nature of the formation being drilled (e.g., lithological or geophysical characteristics). Based on this information, the operator may conclude that the drill bit 102 is traversing a shale layer (e.g., layer 290), which often is an unstable formation that is susceptible to swelling. At the appropriate time, the operator transmits a downlink instructing the hole enlargement device 200 to expand and underream the borehole 12. Thus, with continued drilling, the hole enlargement device 200 increases the diameter of the layer 290 relative to the diameter of the borehole 12 in the stable layer 292. At some point, the operator may conclude that the drill bit 102 has penetrated into a relatively stable layer 292, e.g., a formation having sandstone. Prior to the hole enlargement device 200 entering the relatively stable layer 292, the operator transmits another downlink 262 (FIG. 4) instructing the hole enlargement device 200 to retract and thereby discontinue underreaming. Drilling may continue without extracting the BHA 100 from the well. Advantageously, therefore, the hole enlargement device 200 is operated to underream only one or more selected formations. Moreover, the hole enlargement device 200 may be activated and deactivated as many times as needed while the drilling system 100 is in the wellbore.

In one mode of operation, the measurements of the sensors 264, 266, 268 and/or estimates of parameter based on such measurements may be presented to the operator on the display 54. Illustrative measurements or estimated parameters include switching status (e.g., position of cutting elements 210), hydraulic pressure, temperature, general health status of the tool, detailed blade extension information (e.g., amount of extension), estimated borehole diameter, etc. Furthermore, the operator may transmit signals via the communication system 260 to operate the hole enlargement device 200. For instance, an operator may transmit an "open" or "activate" signal that causes the actuation unit 220 to radially extend the cutting elements 210. After some time, the operator may transmit a "close" or "deactivate" signal that causes the actuation unit 220 to cause the cutting elements 210 to radially retract. It should be appreciated that hydraulic power from clean hydraulic fluid or drilling mud may be used to actively extend and retract the cutting elements 210.

Referring now to FIGS. 1 and 4, it should be appreciated that the hole enlargement devices of the present disclosure provide a wide range of operational functionality beyond selective extension and retraction of the cutting elements 210. For instance, the integration of tools and sensors into the drilling system 100 allows measurements of drilling dynamics that enable the monitoring of the health or condition of the hole enlargement device 200 and also allow analysis of weight and torque distribution between the drill bit 102 and the hole enlargement device 200. For convenience, the hole enlargement device 200 will be referred to as a "reamer 200." Thus, weight on reamer is WOR 284, weight on bit is WOB 286, torque at reamer is TOR 288, and torque at bit is TOB 291. As described previously, and as further described below, this information may be used by the operator to optimize drilling operations.

In one aspect, this information may be used for automated drilling. In certain applications, automated drilling involves adjusting drilling parameters to account for drilling conditions and dynamics. This automated control may be performed by a downhole controller, a surface controller or a combination thereof that are programmed to automatically adjust the operating set points or operating drilling parameters in response to measured and/or calculated drilling dynamics. For example, operating parameters may be automatically adjusted to reduce measured parameters such as vibration, bending moments, etc. Exemplary operating control parameters include, but are not limited to, weight-on-bit, RPM of the drill string, hook load, drilling fluid flow rate, and drilling fluid properties. During operation, the controller(s) may use one or more models for predicting drilling system behavior and the measured drilling dynamics parameters to determine values for one or more drilling parameters that may optimize drilling or maintain selected parameters within specified constraints or ranges.

In another aspect, the reamer and the drill bit may be viewed as an inter-related system wherein the behavior of the reamer influences the behavior of the drill bit and vice-versa. In this scenario, measurements of WOR 284, WOB 286, TOR 288, and TOB 291 may be used to automatically calculate the weight and torque difference between the drill bit and the reamer. The information may be input into an automated drilling system. Alternatively or additionally, this information may be presented to the operator. For instance, the display 54 may provide a numeric value of the differences in weight and torque of the reamer and the drill bit and/or utilize a coding scheme to help evaluate the differences in weight and torque values to recognize critical situations easier (e.g., green to represent an acceptable difference, yellow to represent a cautionary difference, red to represent an unacceptable difference, etc.).

In still another aspect, this information may be used to select drilling parameters that optimize drilling through a variety of formations. For instance, the formation evaluation data may be used to adjust or control the reamer while the reamer traverses a relatively hard formation. The drilling parameters (e.g., WOR, RPM, etc.) may be adjusted to prevent premature wear by limiting overload of the hole enlargement device in the hard formation. Real time or near-real time control and monitoring of the hole enlargement device may be useful in formations such as interbedded formations wherein changes in formation lithology can impose damaging wear if operation of the hole enlargement device is not appropriately varied. Thus, reamer and/or drill bit operations may be controlled in response to formation lithology.

Data representative of drilling dynamics may also be used to properly operate the reamer when encountering problematic formations. Referring now to FIG. 1, in some instances the drill bit 102 may be drilling through a relatively soft layer (e.g., unstable layer 290) while the hole enlargement device 200 is operating in a relatively hard layer (e.g., stable layer 292). In such situations, the hole enlargement device 200 may be subjected to harmful torque (TOR) or weight (WOR). Advantageously, the monitoring of drilling dynamics allows the operator to react to such conditions by instituting the appropriate corrective action. For example, the operator may adjust one or more drilling parameters such that the torque or weight is more evenly distributed (e.g., a fifty percent—fifty percent distribution between the drill bit 102 and the hole enlargement device 200).

From the above, it should be appreciated that what has been described includes, in part, an apparatus that may include a hole enlargement device positioned along a drill string; and a controller operably coupled to the hole enlargement device. The hole enlargement device may include a plurality of cutting elements that may be actuated simultaneously to form a substantially circular wellbore. The controller may be responsive to a first signal and a second signal such that the controller activates the hole enlargement device upon receiving the first signal and deactivates the hole enlargement device upon receiving the second signal. In some arrangements, the controller may activate and de-activate the hole enlargement device several times during a single trip into the wellbore. The steering device and the hole enlargement device may be operated independently of one another. Also, the controller may be responsive to a pressure pulse, an electrical signal, an optical signal, an EM signal, and/or an acoustic signal. In aspects, the drill string may include wired pipe, e.g., drill pipe that has one or more conductors that convey an electrical signal, and/or an optical signal. The apparatus may also include one or more sensors that measure a selected parameter of interest. In one arrangement, the hole enlargement device may include one or more cutting elements and the sensor may measure a displacement of the cutting elements.

From the above, it should be appreciated that what has been described also includes, in part, an apparatus that includes a hole enlargement device positioned along a drill string; and an actuator operably coupled to the hole enlargement device via a fluid circuit. The actuator may supply pressurized fluid via the fluid circuit to activate the hole enlargement device. The actuator may have a hydraulic pump that may be energized by a pressurized fluid flowing in the drill string and/or energized by electrical power. In aspects, the electrical power may be supplied by a downhole battery, a downhole generator, and/or a conductor coupling the hydraulic pump to a surface electrical power supply.

From the above, it should be appreciated that what has been described further includes, in part, a method that includes enlarging a diameter of the wellbore with a hole enlargement device conveyed on a drill string; measuring a parameter of interest using a sensor positioned on the drill string; and controlling the hole enlargement device in response to the measured parameter of interest.

When the drill string includes a drill bit, the method may include drilling the wellbore with the drill bit; measuring a first parameter of interest using a sensor positioned proximate to the drill bit; and controlling the hole enlargement device in response to the measured parameter of interest and the second parameter of interest. In certain applications, the parameter of interest and the second parameter of interest may relate to weight at a selected location on the drill string; weight at the drill bit; torque at a selected location on the drill string; and torque at the drill bit. The method may further include estimating a difference between the weight at a selected location on the drill string and weight at the drill bit and/or the torque at a selected location on the drill string and torque at the drill bit. In some aspects, the method includes adjusting an operating parameter of the hole enlargement device in response to the estimated difference.

When the parameter of interest relates to a formation intersected by the wellbore, the method may include adjusting an operating parameter of the hole enlargement device in response to the measured parameter of interest. In applications wherein the parameter of interest relates to a formation intersected by the wellbore and the drill string includes a bottomhole assembly, the method may include adjusting an operating parameter of the bottomhole assembly in response to the measured parameter of interest. Also, in variants, the operating parameter may include the weight on the hole enlargement device, a rotational speed of the hole enlargement device; and/or flow rate. Further, the method may include displaying on a display device the measured parameter, and/or a value obtained by processing the measured parameter. In some applications, the method may utilize estimating downhole a difference between the weight at a selected location on the drill string and weight at the drill bit and/or the torque at a selected location on the drill string and torque at the drill bit. In applications, displaying on a display device a value of the difference estimated downhole may also be performed.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

We claim:

1. An apparatus for forming a wellbore in an earthen formation, comprising:

a drill string having a drill bit;

a controllable steering device steering the drill bit in a selected direction, the steering device being configured to receive instructions;

a hole enlargement device positioned along the drill string, the hole enlargement device having at least one selectively extendable cutting element configured to form a substantially circular wellbore having a diameter larger than the wellbore formed by the drill bit;

a drilling motor for rotating the hole enlargement device and the drill bit, wherein the hole enlargement device and the steering device are positioned between the drilling motor and the drill bit;

a controller programmed to activate the hole enlargement device upon receiving a first signal and deactivate the hole enlargement device upon receiving a second signal;

a sensor positioned on the hole enlargement device uphole from the at least one selectively extendable cutting element and configured to sense a measured parameter of interest, wherein the measured parameter of interest is at least one of weight-on-hole enlargement device and torque-on-hole enlargement device, wherein at least one of the first signal and the second signal are generated at least partially in response to weight-on-hole enlargement device and torque-on-hole enlargement device data collected from the sensor;

a second sensor proximate the drill bit configured to measure a second parameter of interest, wherein the second parameter of interest relates to one of:

(i) weight at the drill bit; and (ii) torque at the drill bit; and wherein the controller is further programmed to control the hole enlargement device in response to the difference between the measured parameter of interest and the second parameter of interest.

2. The apparatus according to claim 1, wherein the controller is responsive to a signal that is one of: (i) a pressure pulse, (ii) an electrical signal, (iii) an EM signal, (iv) an acoustic signal, and (v) an optical signal.

3. The apparatus according to claim 1, wherein the drill string includes at least one conductor configured to convey one of: (i) an electrical signal, and (ii) an optical signal.

4. The apparatus according to claim 1, further comprising at least one sensor positioned on the drill string and that is configured to measure a selected parameter of interest.

5. The apparatus according to claim 4, wherein the hole enlargement device includes at least one cutting element and wherein the at least one sensor measures a displacement of the at least one cutting element.

6. The apparatus according to claim 1, wherein the at least one selectively extendable cutting element includes a plurality of cutting elements configured to be actuated substantially simultaneously, and further comprising: a pump supplying fluid to move the at least one cutting element between an extended state and a retracted state.

7. The apparatus according to claim 6, wherein the pump is energized by one of: (i) a pressurized fluid flowing in the drill string, and (ii) electrical power.

8. The apparatus according to claim 6, further comprising a conductor coupling the pump to a surface electrical power supply.

9. The apparatus according to claim 1, wherein the hole enlargement device is positioned between the steering device and the drill bit.

10. The apparatus according to claim 1, further comprising a downhole processor configured to control a drilling parameter relating to the hole enlargement device.

11. A method for forming a wellbore in an earthen formation, comprising:

drilling the wellbore using a drill string having a drill bit;

steering the drill bit using a controllable steering device configured to receive instructions;

enlarging a diameter of the wellbore with a hole enlargement device conveyed on the drill string, the enlarged wellbore being substantially circular;

measuring a parameter of interest using a sensor positioned on the drill string uphole from at least one cutting element of the hole enlargement device;

controlling a difference in a torque and a weight between the hole enlargement device and the drill bit in response to the measured parameter of interest while enlarging the wellbore diameter, wherein the measured parameter of interest is at least one of (i) weight at the hole enlargement device, and (ii) torque at the hole enlargement device;

measuring a second parameter of interest using a sensor positioned proximate to the drill bit, the second parameter of interest relating to one of:

(i) weight at the drill bit; and (ii) torque at the drill bit; and controlling the hole enlargement device in response to the difference between the measured parameter of interest and the second parameter of interest.

12. The method according to claim 11, further comprising controlling the hole enlargement device by estimating a difference between one of: (i) weight at the hole enlargement device and weight at the drill bit; and (ii) torque at the hole enlargement device and torque at the drill bit.

13. The method according to claim 12, further comprising displaying on a display device a value of the difference estimated downhole.

14. The method according to claim 12, further comprising adjusting an operating parameter of the hole enlargement device in response to the estimated difference.

15. The method according to claim 11, further comprising estimating a parameter of interest relating to a formation intersected by the wellbore, wherein the drill string includes a bottomhole assembly and further comprising: adjusting an operating parameter of the bottomhole assembly in response to the measured parameter of interest relating to the formation.

16. The method according to claim 14, wherein the operating parameter is one of: (i) weight on the hole enlargement device, (ii) a rotational speed of the hole enlargement device; and (iii) flow rate.

* * * * *